United States Patent [19]

Davenport

[11] Patent Number: 5,068,502

[45] Date of Patent: Nov. 26, 1991

[54] MAGNETICALLY BIASED VELOCITY CHANGE SENSOR

[75] Inventor: Thomas A. Davenport, Chatham, Canada

[73] Assignee: Siemens-Bendix Automotive Electronics Limited, Ontario, Canada

[21] Appl. No.: 435,102

[22] Filed: Nov. 13, 1989

[51] Int. Cl.[5] ..... H01H 35/14

[52] U.S. Cl. ..... 200/61.45 M; 200/61.45 R; 200/61.53

[58] Field of Search ..... 200/61.45 R, 61.45 M–61.53

[56] References Cited

U.S. PATENT DOCUMENTS

| | | | |
|---|---|---|---|
| 3,859,645 | 1/1975 | Szeverenyi | 337/324 X |
| 4,082,927 | 4/1978 | Beckwith | 200/61.45 M X |
| 4,329,549 | 5/1982 | Breed | 200/61.45 M |

*Primary Examiner*—J. R. Scott

*Attorney, Agent, or Firm*—George L. Boller; Russel C. Wells

[57] ABSTRACT

A magnetically biased velocity change sensor that is designed for mass-production fabrication and ensuing usage in supplemental inflatable restraint systems of automotive vehicles. The sensor is of the type having a metal sphere that is magnetically biased to one axial end of a tube. When the sensor is subjected to a velocity change of suitable magnitude and duration, the sphere travels to the opposite end of the tube to actuate a switch. Damping of the sphere travel is accomplished by sizing the tube to be of just slightly larger inside diameter than the diameter of the sphere. The invention enhances the manufacturability of the sensor by making dimensioning requirements for the tube and sphere less strict and by enabling different models of sensors to be fabricated from commonly dimensioned tubes and spheres. The invention involves manufacturing the sphere as a sintered iron mass and using a mixture of gases within the tube.

4 Claims, 1 Drawing Sheet

MAGNETICALLY BIASED VELOCITY CHANGE SENSOR

BACKGROUND AND SUMMARY OF THE INVENTION

This invention relates to a magnetically biased velocity change sensor of the type comprising a tube having a circular cylindrical inside diameter containing a magnetically permeable sphere whose diameter is just slightly less than the tube's inside diameter so that travel of said sphere within said tube is damped by gaseous fluid present within said tube, a magnet for biasing said sphere axially within said tube against a stop proximate one axial end of said tube, a switch disposed proximate the opposite axial end of said tube for actuation by said sphere in response to said sensor experiencing a velocity change of sufficient magnitude and duration to cause said sphere to overcome the bias of said magnet and travel within said tube from the position against said stop to a position causing said switch to give a signal indicative of the occurrence of such velocity change. Sensors of this type are presently in use in the automotive industry in passive occupant restraint (air bag) systems.

An example of this type of velocity change sensor is disclosed in U.S. Pat. No. to Breed 4,329,549 issued May 11, 1982. The mass production of this sensor requires very close control of part dimensions and tolerances in order to comply with functional specifications. Such need for this degree of control is a factor in the cost which the customer must pay for the sensor. If the cost of manufacturing the sensor can be reduced while compliance with applicable specifications is maintained, a meaningful savings can accrue. It is toward this objective that the present invention is directed.

One of the problems confronting a simplification in manufacturing procedures is the fact that the response characteristic of a particular sensor for a particular automotive vehicle model is usually unique. In other words, the sensor manufacturer must build a number of different models of sensor, even though the models are basically the same. One aspect of the present invention involves an improvement whereby certain models of sensors differ in their response characteristics solely by differences in the viscosities of their gaseous damping fluids. This improvement enables the sensors to share component parts of identical dimensions and tolerances, thereby simplifying manufacturing considerations.

Another aspect of the invention involves a reduction in the strictness of dimensional tolerance requirements for certain component parts, in particular the diameter of the sphere and the inside diameter of the tube. This improvement is accomplished by a novel construction for the sphere which retains its magnetic permeability, but with a significantly lower mass. Exactly how this occurs will be seen in the detailed description of a preferred embodiment. A drawing also accompanies the description. Taken together, the description and drawing present the best mode contemplated by the inventor at the present time for carrying out the invention. Additional advantages, features, and benefits of the invention will suggest themselves to the reader as the disclosure proceeds.

DESCRIPTION OF THE PREFERRED EMBODIMENT

Figure 1:
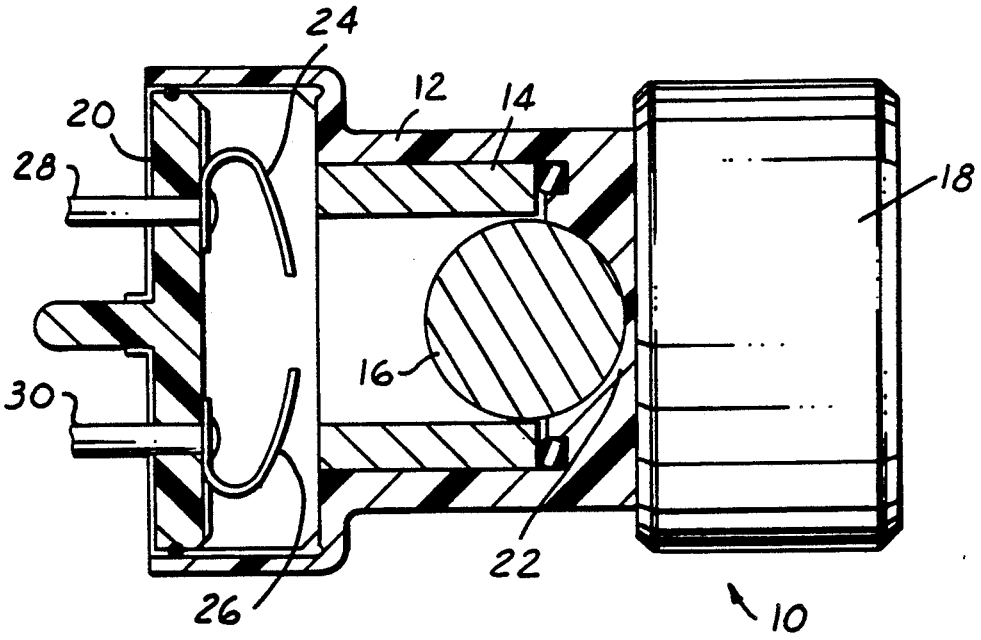
FIG. 1 is a longitudinal view partly in cross section of a velocity change sensor embodying principles of the invention.

The drawing illustrates a velocity change sensor 10 comprising a non-metallic body 12 of generally cylindrical shape, a tube 14 fixedly disposed within body 12, a sphere 16 is disposed within tube 14, a permanent magnet 18 fixedly disposed on one axial end of body 12, and a switch assembly 20 fixedly disposed on the opposite axial end of body 12.

Body 12 is shaped with a transverse wall 22 that closes the axial end portion of body 12 onto which magnet 18 is disposed. Switch assembly 20 closes the opposite axial end of body 12. Body 12 is of a non-magnetically permeable material and sphere 16 is of magnetically permeable material so that magnet 18 attracts sphere 16 into abutment with transverse wall 22 while a majority of the sphere remains within tube 14. In this way wall 22 forms a stop for sphere 16 proximate the right end of tube 14.

Switch assembly 20 comprises a pair of electrically conductive contacts 24, 26 that are poised to be bridged by sphere 16 upon displacement of the sphere from the right end to the left end of tube 14. Each contact 24, 26 is in conductive relationship with a corresponding terminal 28, 30 on the exterior of the sensor. It is via these terminals that the sensor provides a switch signal when contacts 24, 26 are bridged by sphere 16.

The drawing illustrates the sensor in the non-actuated condition that it normally assumes. In this condition, sphere 16 is biased against wall 22, and there is no circuit continuity between terminals 28 and 30. If the sensor is subjected to a velocity change of suitable magnitude and duration in the proper sense along the axial direction, sphere 16 will travel from right to left and bridge contacts 24, 26 to create circuit continuity between terminals 28, 30 thereby causing the sensor to give a signal indicating the occurrence of such a velocity change.

The motion of sphere 16 within tube 14 is damped by the gaseous fluid present within tube 14 because the diameter of the sphere is made just slightly smaller than the inside diameter of the circular cylindrical wall of the tube. If the velocity change is not of sufficient magnitude and duration to cause the sphere to bridge contacts 24, 26, the bias force exerted by magnet 18 on the sphere is sufficient to pull the sphere back into abutment with wall 22, in effecting resetting the sensor for suitable response to future velocity changes. This much of the description of FIG. 1 represents the basic construction and operation of this type of sensor.

One of the aspects of the present invention involves an improved construction for sphere 16. Heretofore the sphere has been a steel ball bearing, which has a density of essentially 7.9 grams per cubic centimeter (gms./cc.). For a given size sphere 16 and tube 14, the damping force that is exerted on the traveling sphere is a function of the mass of the sphere and the viscosity of the gaseous fluid within tube 14. If the mass of the sphere could be reduced, so could the damping force required to obtain a specified performance from the sensor. For a given damping fluid, lower damping force can be achieved by increasing the clearance between the sphere and the tube. Since the tolerance required on this clearance is essentially a fixed fraction of the clearance, it follows that an increase in the clearance will permit an increase in the dimensional tolerances on the sphere and the tube. Because the clearance is typically quite small, on the order of one thousandth of an inch, and the tolerance on the clearance must be extremely closely controlled, on the order of twenty millionths of an inch, less strict dimensional requirements on the parts involved are possible and this is especially advantageous.

A solution that is provided by the present invention is the fabrication of sphere 16 as a sintered iron ball through the use of powder metallurgy or sintering techniques. Current powder metallurgy techniques can produce sintered iron with a density of 5.7 gms./cc., significantly lower than that of conventional steel which has 7.9 gms./cc. Thus for a given size sphere, the application of the invention will provide a less massive component, yet one that is still magnetically permeable. As a consequence, the aforementioned advantages can accrue.

A further aspect of the invention involves the use of different viscosity fluids for the gaseous damping fluids within tube 14. For a sensor constructed from components of given sizes, a change in the viscosity of the gaseous damping fluid will change the performance characteristics of the sensor. Accordingly, it becomes possible to manufacture different models of sensors from the same size component parts simply by changing the viscosity of the particular damping fluid that is used in each model of sensor.

An especially desirable procedure for conveniently changing the fluid viscosity is by using a mixture of only two gases for the damping fluid, and varying the viscosity by changing the relative proportions of the two gases constituting the mixture. For example a mixture of carbon dioxide and neon can provide desirable characteristics. If the viscosity of air at a temperature of 20 degrees Centigrade is defined to be 1.0, then the viscosity of a carbon dioxide/neon mixture will vary from 1.5 for pure neon to 0.6 for pure carbon dioxide, with an approximately proportional range in between. Such a range of viscosity would be sufficient to permit a range of sensor calibration encompassing current specifications for automotive vehicle usage, thereby enabling all current sensors to be fabricated from the same identical tubes and spheres. Fabrication of the sensors must provide for the filling and permanent containment of the gaseous fluid mixture within the sensor. This can be done by conventional procedures such as in a special environment or by evacuation, filling and sealing.

While a presently preferred embodiment of the invention has been disclosed and described, it will be appreciated that principles are applicable to other embodiments.

What is claimed is:

1. In a velocity change sensor of the type comprising a tube having a circular cylindrical inside diameter containing a magnetically permeable sphere whose diameter is just slightly less than the tube's inside diameter so that travel of said sphere within said tube is damped by gaseous fluid present within said tube, a magnet for biasing said sphere axially within said tube against a stop proximate one axial end of said tube, a switch disposed proximate the opposite axial end of said tube for actuation by said sphere in response to said sensor experiencing a velocity change of sufficient magnitude and duration to cause said sphere to overcome the bias of said magnet and travel within said tube from the position against said stop to a position causing said switch to give a signal indicative of the occurrence of such velocity change, the improvement comprising said sphere consisting of iron having a density of essentially 5.7 grams per cubic centimeter.

2. The improvement set forth in claim 1 comprising said gaseous fluid consisting of a carbon dioxide-neon mixture that is essentially free of other gases.

3. In a velocity change sensor of the type comprising a tube having a circular cylindrical inside diameter containing a magnetically permeable sphere whose diameter is just slightly less than the tube's inside diameter so that travel of said sphere within said tube is damped by gaseous fluid present within said tube, a magnet for biasing said sphere axially within said tube against a stop proximate one axial end of said tube, a switch disposed proximate the opposite axial end of said tube for actuation by said sphere in response to said sensor experiencing a velocity change of sufficient magnitude and duration to cause said sphere to overcome the bias of said magnet and travel within said tube from the position against said stop to a position causing said switch to give a signal indicative of the occurrence of such velocity change, the improvement comprising said gaseous fluid consisting of a carbon dioxide-neon mixture that is essentially free of other gases and can range from essentially all carbon dioxide to essentially all neon.

4. In the method of making different models of velocity change sensors of the type comprising a tube having a circular cylindrical inside diameter containing a magnetically permeable sphere whose diameter is just slightly less than the tube's inside diameter so that travel of said sphere within said tube is damped by gaseous fluid present within said tube, a magnet for biasing said sphere axially within said tube against a stop proximate one axial end of said tube, a switch disposed proximate the opposite axial end of said tube for actuation by said sphere in response to said sensor experiencing a velocity change of sufficient magnitude and duration to cause said sphere to overcome the bias of said magnet and travel within said tube from the position against said stop to a position causing said switch to give a signal indicative of the occurrence of such velocity change, wherein the different models are characterized by different velocity response characteristics, the improvement which comprises making all such models from spheres of identical mass and diameter and from tubes of identical inside diameter and length, and filling each model with a gaseous fluid of a viscosity that is unique to the particular model, wherein the gaseous fluid filling each model comprises a mixture consisting essentially of two gases of different viscosity whose relative proportions are varied for different models, said mixture is a carbon dioxide-neon mixture that is essentially free of other gases and can range from essentially all carbon dioxide to essentially all neon.

* * * * *